US009825415B1

(12) United States Patent
Lin et al.

(10) Patent No.: US 9,825,415 B1
(45) Date of Patent: Nov. 21, 2017

(54) ADAPTER CASING MODULE FOR INSTALLING A POWER SOCKET

(71) Applicant: Chicony Power Technology Co., Ltd., New Taipei (TW)

(72) Inventors: Ming-Hui Lin, New Taipei (TW); Po-Sheng Lee, New Taipei (TW)

(73) Assignee: CHICONY POWER TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/438,538

(22) Filed: Feb. 21, 2017

(30) Foreign Application Priority Data

Dec. 8, 2016 (TW) ..... 105140566 A

(51) Int. Cl.

| | |
|---|---|
| ***H01R 13/514*** | (2006.01) |
| ***H01R 31/06*** | (2006.01) |
| ***H01R 13/506*** | (2006.01) |
| ***H01R 13/424*** | (2006.01) |

(52) U.S. Cl.
CPC ..... *H01R 31/06* (2013.01); *H01R 13/424* (2013.01); *H01R 13/506* (2013.01)

(58) Field of Classification Search
CPC ..... H01R 9/223; H01R 13/505; H01R 13/516
USPC ..... 439/731, 465, 687, 906
See application file for complete search history.

(56) References Cited

U.S. PATENT DOCUMENTS 5,159,545 A 10/1992 Lee
7,241,169 B1 * 7/2007 Yang ..... H01R 31/06 439/172
7,717,720 B2 * 5/2010 Ikeda ..... H01H 50/048 439/701
8,002,569 B2 * 8/2011 Ikeda ..... H01H 50/048 439/374
8,162,701 B2 * 4/2012 Lee ..... H01R 13/652 439/731
9,640,901 B2 * 5/2017 Hasegawa ..... H01H 50/048
2016/0072222 A1 * 3/2016 Hasegawa ..... H01H 50/048 439/382

FOREIGN PATENT DOCUMENTS

CN 1725565 A 1/2006
TW 450462 U 8/2001

OTHER PUBLICATIONS

Office Action dated Sep. 13, 2017 of the corresponding Taiwan patent application No. 105140566.

* cited by examiner

*Primary Examiner* — Hae Moon Hyeon
(74) *Attorney, Agent, or Firm* — Chun-Ming Shih; HDLS IPR Services

(57) ABSTRACT

An adapter casing module for installing a power socket includes a first casing and a second casing engaged correspondingly with the first casing, and the first casing has a fixed base, and the second casing has an opening disposed opposite to the fixed base, and the fixed base includes two elastic walls protruded from the first casing, and the two elastic walls are arranged with an interval apart and opposite to each other for installing the power socket between the elastic walls, and a first limit structure is disposed on a side of the two elastic walls, and a second limit structure is disposed on the other side of the two elastic walls, and the first and second limit structures are provided for limiting the power socket to be situated in the fixed base and configured to be corresponsive to the opening of the second casing.

10 Claims, 7 Drawing Sheets

ADAPTER CASING MODULE FOR INSTALLING A POWER SOCKET

FIELD OF THE INVENTION

This disclosure relates to a power adaptor, and more particularly to an adapter casing module for installing a power socket.

BACKGROUND OF THE INVENTION

In general, a power adapter is used as a power conversion accessory of portable electronic products and comprised of a casing, a control circuit board installed in the casing, and components such as inductor, a capacitor, and a transformer installed on the control circuit board and has a power input end and a power output end for inputting an alternating current from the power input end, converting the alternating current (AC) into direct current (DC), and then outputting the DC from the power output end to an electronic product that requires a power supply.

However, the conventional power adapter is formed by a power socket such as an (AC socket) at the power input or output end, and clamped between upper and lower casings, but such assembling method restricts the product, such that the power socket can be installed at an edge of the outer casing only and the plug opening of the power socket cannot be arranged at an upper or lower surface of the outer casing or just at a position on the surface of any one of the casings to change the relative position of the power plug in order to meet different using requirements. In the meantime, when the power socket is simply installed on a surface of any one of the casings, the conventional structure just has an opening formed on any one of the casings and configured to be corresponsive to the jack of the power socket, so that the power socket fails to provide a good fixing effect. During a conventional way of installing the adapter, components such as the control circuit board are installed in one of the casings first. If the power socket further requires another casing, the wiring between the power socket and the control circuit board must be extended to overcome the level of difficulty for the installation.

In view of the aforementioned drawbacks of the prior art, the discloser of this disclosure based on years of experience in the related industry to conduct extensive research, and finally developed an adapter casing module according to this disclosure to overcome the drawbacks of the prior art.

SUMMARY OF THE INVENTION

Therefore, it is a primary objective of the present invention to provide an adapter casing module for installing a power socket of an adapter securely and facilitating the installation.

Another objective of this disclosure is to provide an adapter casing module, such that the power socket can be installed securely by the aforementioned structure, and the plug surface of the power socket can be controlled easily to be aligned precisely with a surface of the casing module to improve the consistency of the appearance of the assembled product.

To achieve the aforementioned and other objectives, this disclosure provides an adapter casing module for installing a power socket, and the casing module comprises a first casing, a second casing engaged correspondingly with the first casing, and the first casing has a fixed base, and the second casing has an opening disposed opposite to the fixed base, and the fixed base includes two elastic walls protruded from the first casing, and two elastic walls are arranged with an interval apart and opposite to each other for installing the power socket between the two elastic walls, and a first limit structure is disposed on a side of the two elastic walls, and a second limit structure is disposed on the other side of the two elastic walls, and the first and second limit structures are provided for limiting the power socket to be situated in the fixed base and configured to be corresponsive to the opening of the second casing.

DESCRIPTION OF THE PREFERRED EMBODIMENTS

The technical contents of the present invention will become apparent with the detailed description of preferred embodiments accompanied with the illustration of related drawings as follows. It is noteworthy that the preferred embodiments are provided for illustrating this disclosure rather than restricting the scope of the disclosure.

Figure 1:
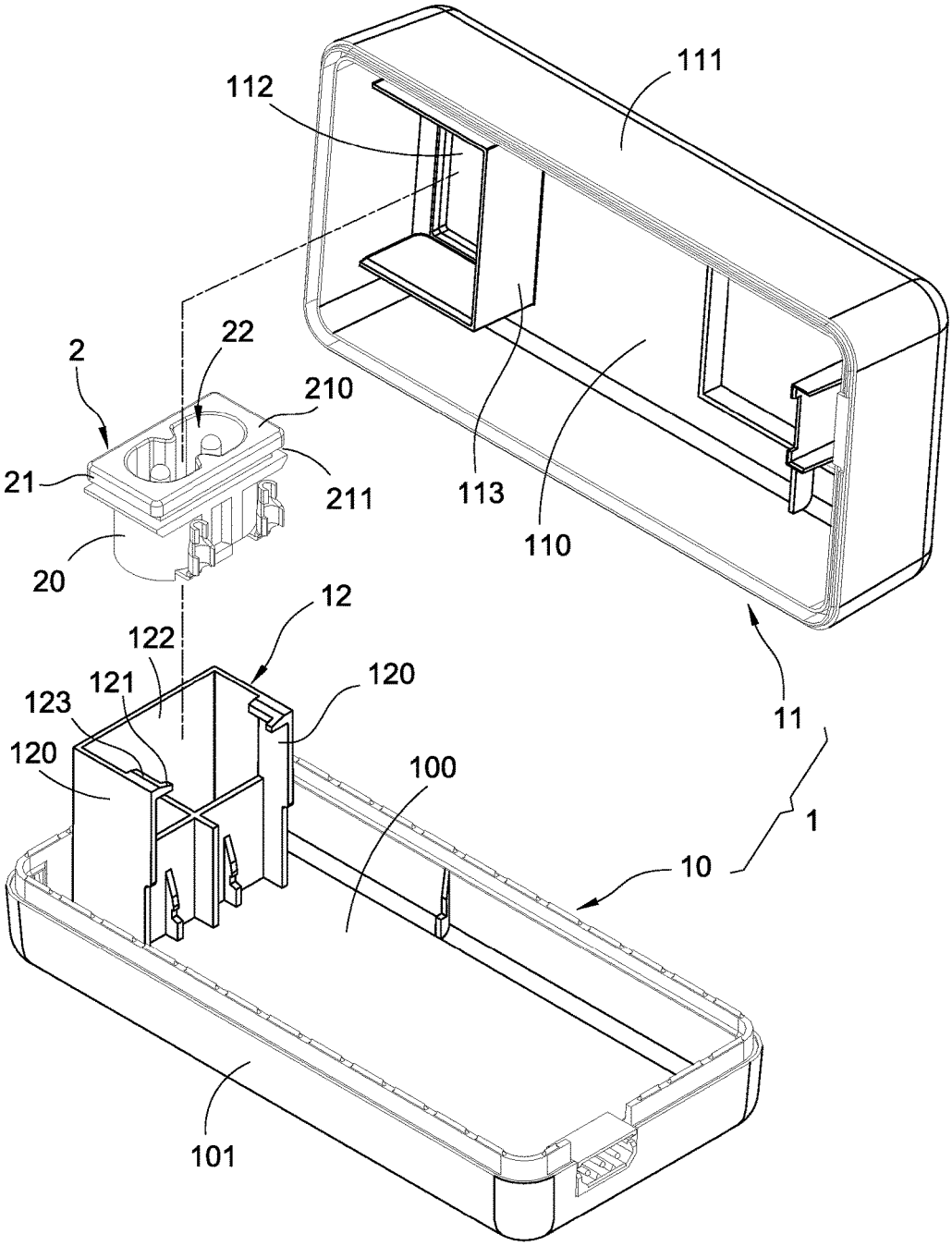
FIG. 1 is an exploded view of an adapter casing module with a power socket in accordance with this disclosure.

With reference to FIG. 1 for an exploded view of an adapter casing module and a power socket in accordance with this disclosure, the adapter casing module 1 is provided for installing a power socket 2 and its related electronic components such as a control circuit board (not shown in the figure) into the casing module 1. The power socket 2 has a socket body 20 and a plug end 21 formed on the socket body 20, and the plug end 21 has a jack 22 communicated with the socket body 20, and a related connecting component such as a terminal (not shown in the figure) is installed in the jack 22. The casing module 1 includes a first casing 10 and a second casing 11 engaged correspondingly with the first casing 10.

The first casing 10 has a bottom 100, and a first side portion 101 disposed continuously around the periphery of the bottom 100 to form a shell-shaped structure for installing the aforementioned power socket 2 or a related component such as a control circuit board, and a fixed base 12 is disposed on an inner surface of the bottom 100 and provided for installing the power socket 2 thereon. The casing module 1 of this disclosure is primarily provided for installing the power socket 2, and thus the remaining electronic components or module will not be described or shown in the figures.

The second casing 11 is engaged correspondingly with the first casing 10, and the second casing 11 also has a top 110 and a second side portion 111 disposed continuously around the periphery of the top 110, and an opening 112 is disposed opposite to the fixed base 12. In other words, the opening 112 is disposed on the top 110. When the power socket 2 is installed on the fixed base 12, the jack 22 faces the opening 112, so that the engaged power plug (not shown in the figure) can be connected to the power socket 2 through the opening 112.

In this disclosure, the fixed base 12 mainly includes two elastic walls 120 protruded from the bottom 100 of the first casing 10, and the two elastic walls 120 are arranged with an interval apart and opposite to each other, so that the power socket 2 can be installed at a position within the interval between the two elastic walls 120, and at least a first limit structure 121 is installed on a common side of the two elastic walls 120, and a second limit structure 122 is installed on the other side, and the first and second limit structures 121, 122 are provided for restricting the power socket 2 to be situated at the fixed base 12 and within the distance between the two elastic walls 120, so that the plug end 21 of the power socket 2 can be aligned precisely with the opening 112 of the second casing 11 after the first and second casings 10, 11 are engaged.

Figure 2:
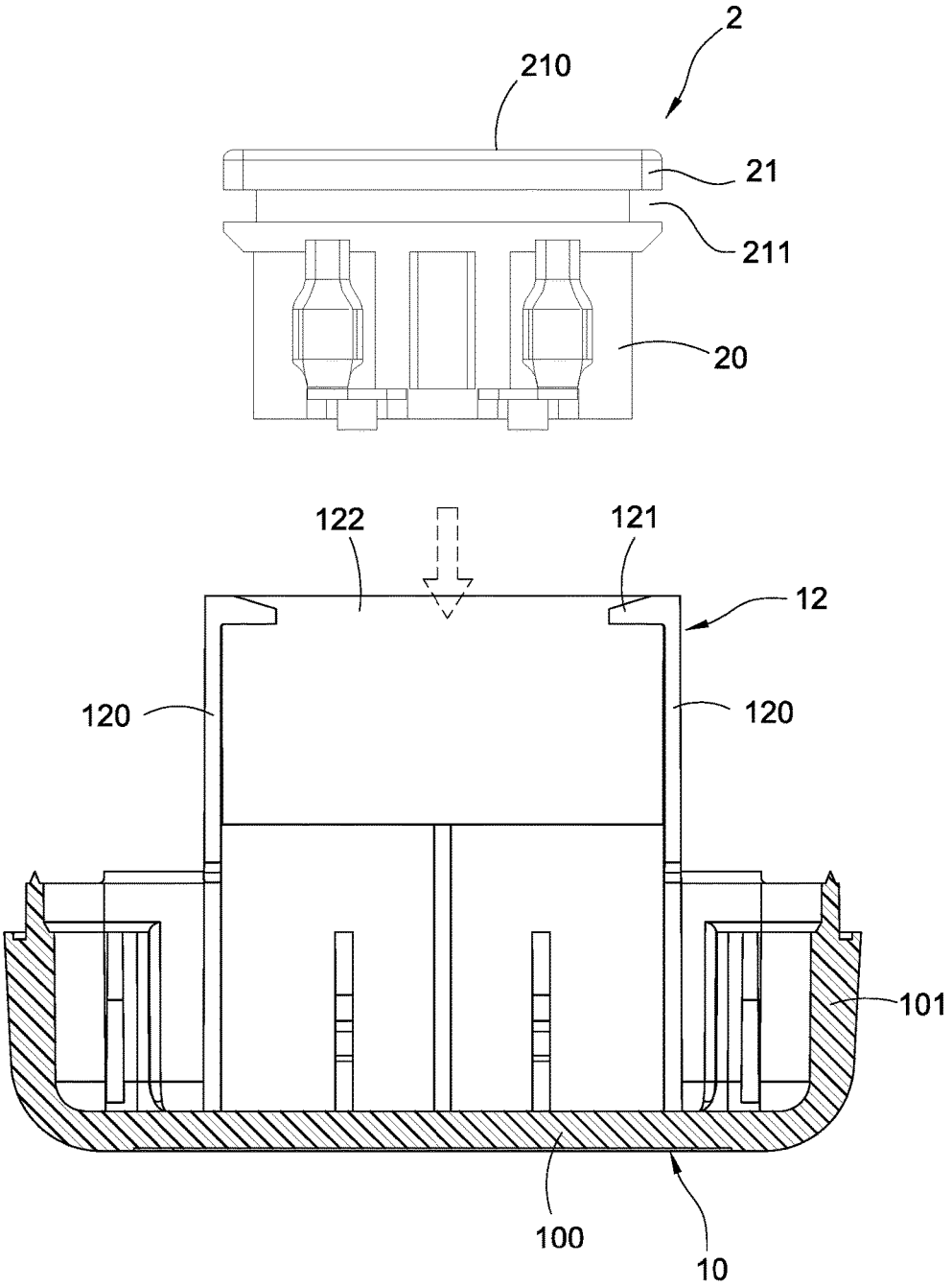
FIG. 2 is a schematic view showing an action before assembling a first casing and a power socket in accordance with this disclosure.
Figure 3:
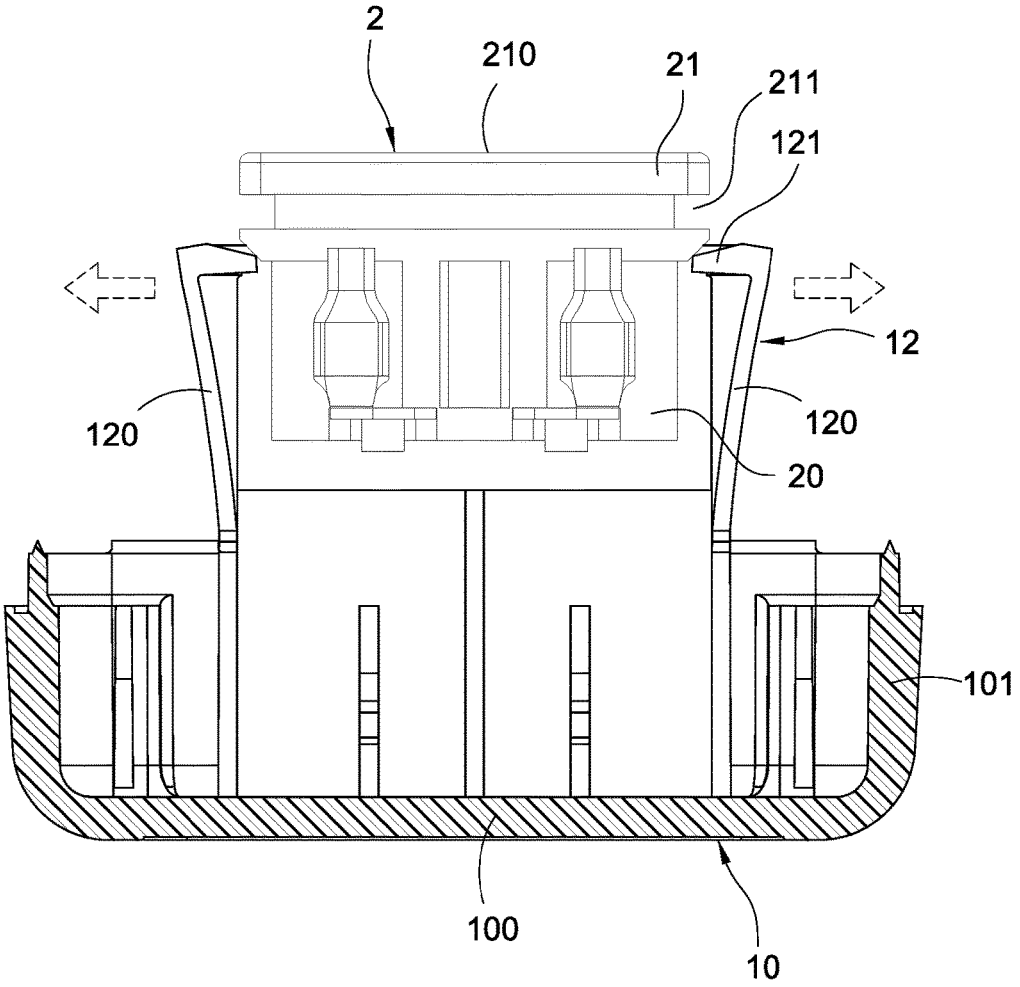
FIG. 3 is a schematic view showing an action while assembling a first casing and a power socket in accordance with this disclosure.
Figure 4:
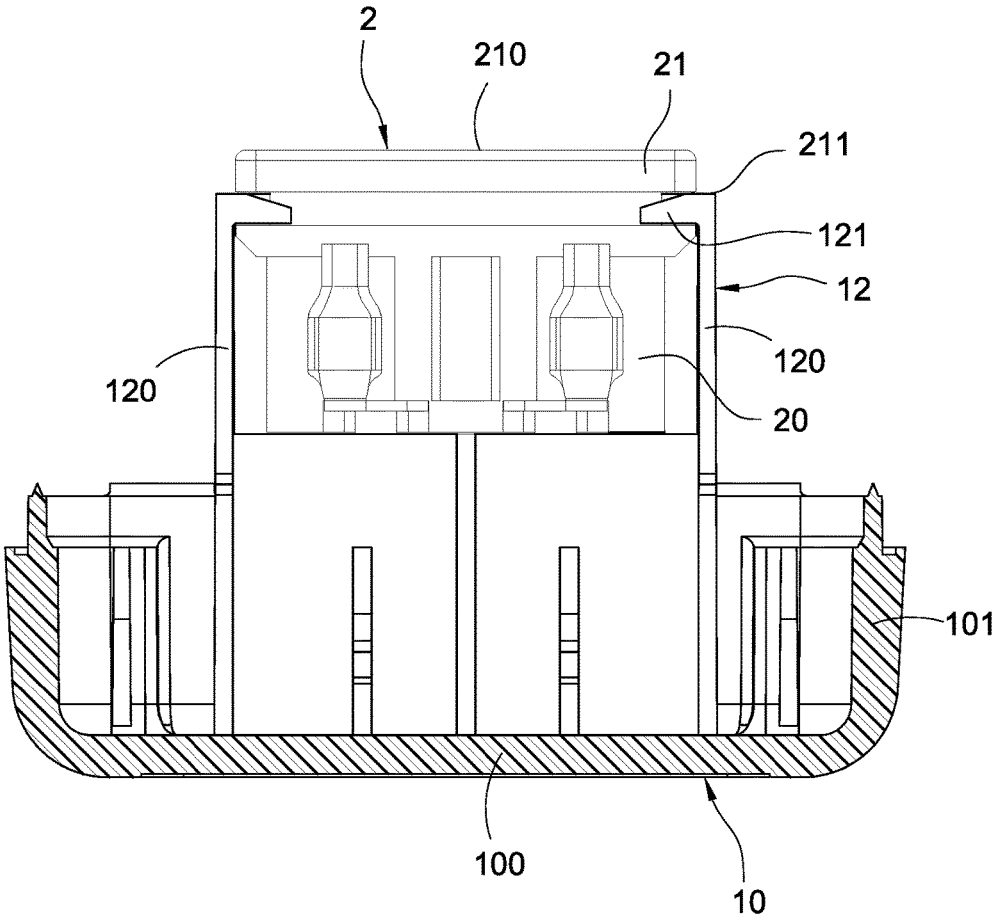
FIG. 4 is a schematic view showing an action after assembling a first casing and a power socket in accordance with this disclosure.
Figure 5:
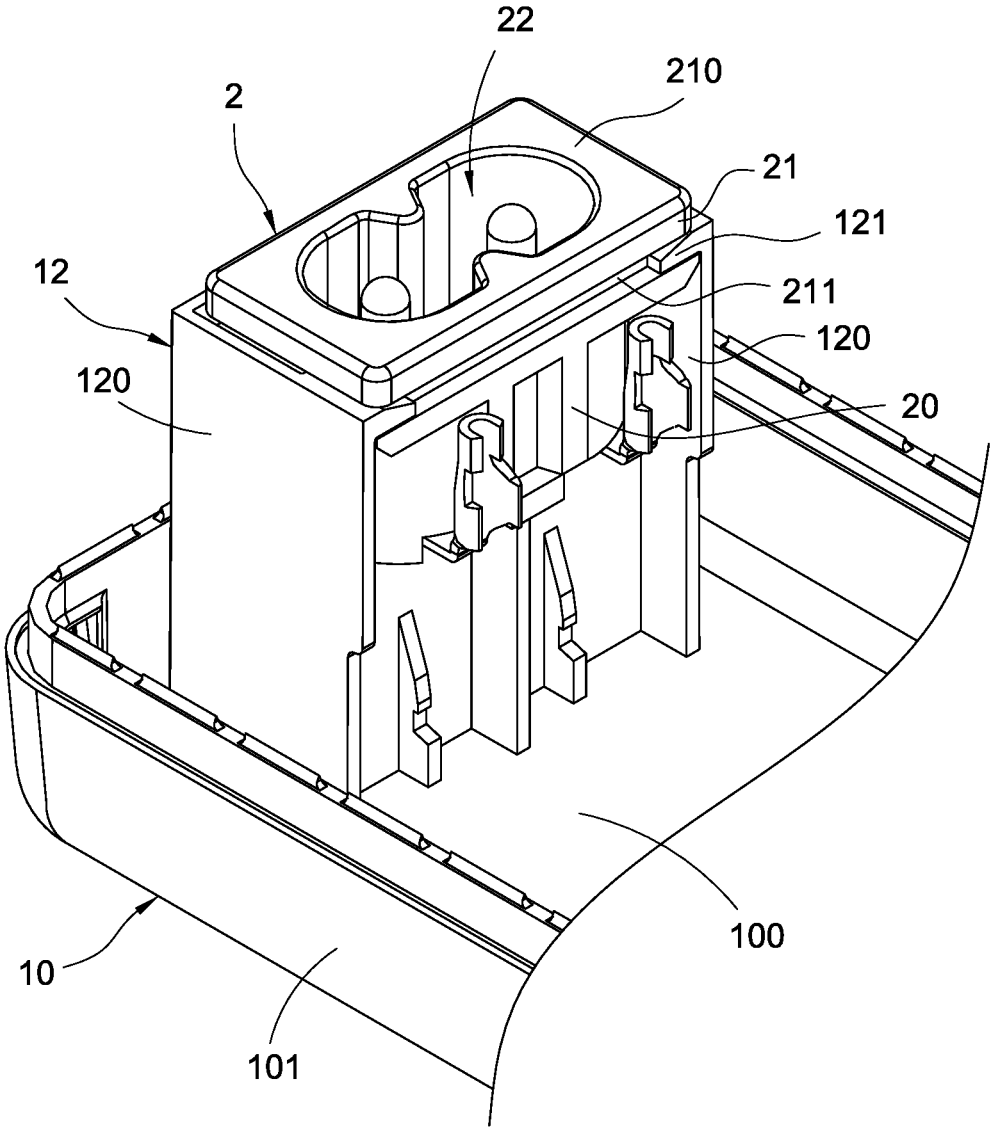
FIG. 5 is a partial perspective view of a first casing and a power socket in accordance with this disclosure after being assembled.
Figure 6:
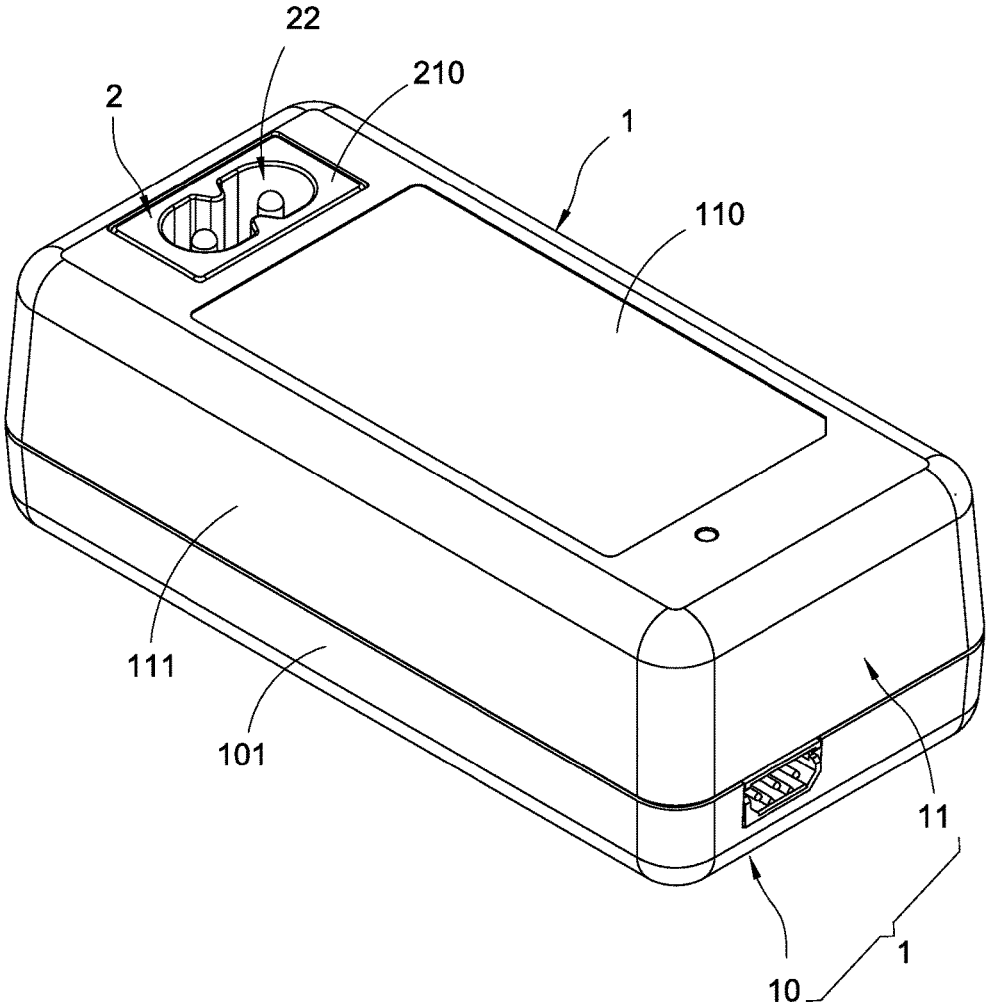
FIG. 6 is a perspective view of an adapter casing module and a power socket in accordance with this disclosure.

During the assembling of this disclosure, related electronic component such as the control circuit board in the adapter may be installed in the first casing 10, and then the power socket 2 is assembled. In FIG. 2, the power socket 2 is pressed from the top of the fixed base 12, and a plug surface 210 of the plug end 21 of the power socket 2 faces upward. In FIG. 3, when the power socket 2 touches the two elastic walls 120 of the fixed base 12, at least one side of the first limit structure 121 between the two elastic walls 120 is situated in an open status, so that the two elastic walls 120 receive the downwardly pressed pressure of the power socket 2 to spread outwardly due to the plastic material of the elastic wall, and the power socket 2 is pressed into the interval between the two elastic walls 120 correspondingly. After the power socket 2 is pressed between two elastic walls 120 as shown in FIGS. 4 and 5, the first limit structure 121 disposed on a side of the two elastic walls 120 and the second limit structure 122 disposed on the other side are provided for restricting the power socket 2 in the fixed base 12. Finally, the second casing 11 and the first casing 10 are engaged with each other to complete the assembly of this disclosure (as shown in FIG. 6).

With the aforementioned structure and assembly, the adapter casing module of this disclosure is formed.

Figure 7:
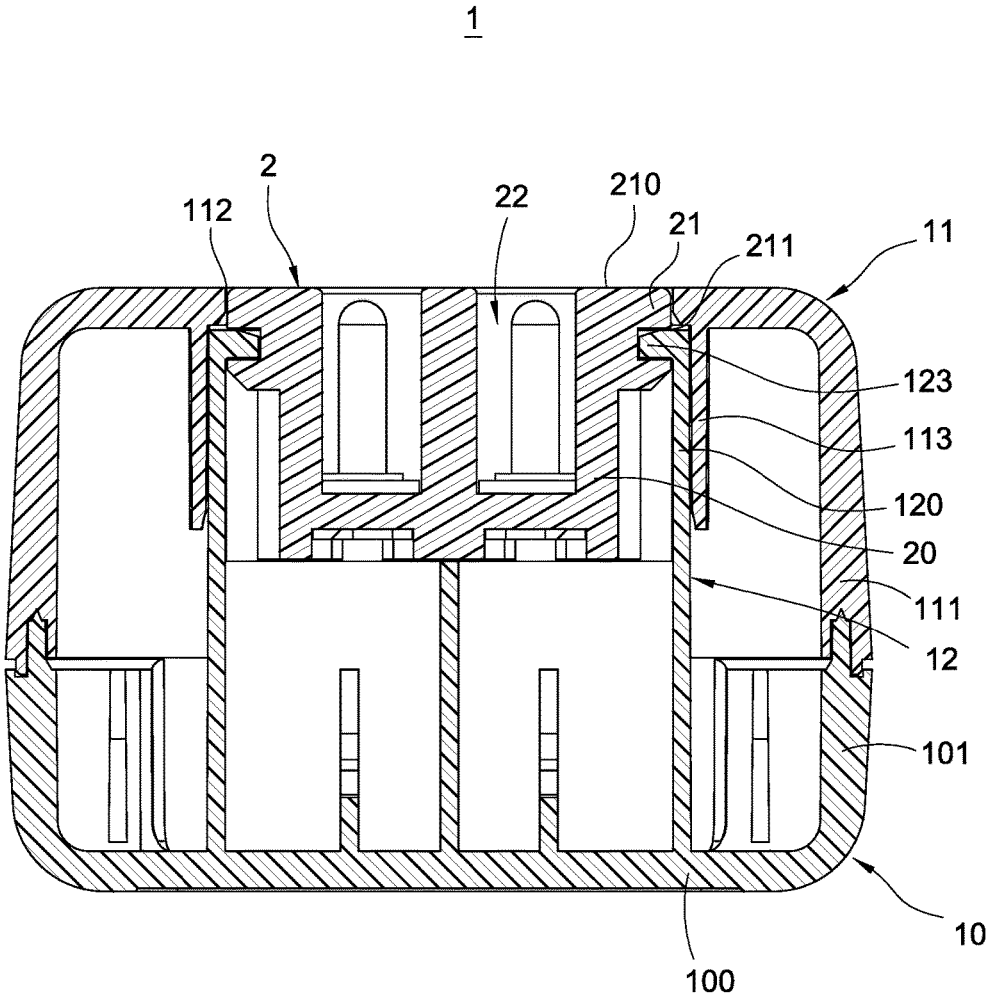
FIG. 7 is a cross-sectional view of an adapter casing module and a power socket in accordance with this disclosure.

In the assembly as shown in FIG. 7, when related electronic components such as a control circuit board of this disclosure is installed in the first casing 10 or the power socket 2 is installed in the fixed base 12, the convenience of the installation will not be affected by the wiring between the power socket 2 and the control circuit board. In addition, the fixed base 12 can securely limits the position of the power socket 2, so that after the second casing 11 is engaged with the first casing 10, the plug surface 210 of the plug end 21 of the power socket 2 is aligned precisely with the opening 112 of the second casing 11, and thus the plug surface 210 can be controlled to be aligned precisely with the outer surface of the top 110 of the second casing 11, so as to improve the consistence of the appearance of the assembled product.

With reference to FIGS. 1 and 7, a retaining wall 113 is protruded from the inner surface of the top 110 of the second casing 11 and around the opening 112, so that when the second casing 11 is installed on the first casing 10, the retaining wall 113 is sheathed and fixed on the fixed base 12. In other words, the retaining wall 113 surrounds the two elastic walls 120 to ensure that the two elastic walls 120 has the effects of restricting the power socket 2 and maintaining the position limiting effect. In addition, an embedded slot 211 is formed around the outer periphery of the plug end 21 of the power socket 2, so that the two elastic walls 120 may have a latching edge 123 protruded along the upper end of any one of the elastic wall 120 and facing the embedded slot 211 of the power socket 2, and the latching edge 123 can be latched into the embedded slot 211 of the power socket 2. In a preferred embodiment of this disclosure, the first limit structure 121 is extended out from an end of the latching edge 123, and the second limit structure 122 is an erected wall integrally coupled to the other side of the two elastic walls 120, so that the two elastic walls 120 and the second limit structure 122 form a U-shaped.

In summation of the description above, the electric connector of this disclosure achieves the expected effects, overcomes the drawbacks of the prior art, and complies with the patent application requirements, and thus is duly filed for patent application. While the invention has been described by means of specific embodiments, numerous modifications and variations could be made thereto by those skilled in the art without departing from the scope and spirit of the invention set forth in the claims.

What is claimed is:

1. An adapter casing module, for installing a power socket, comprising:

a first casing, having a fixed base; and a second casing, engaged correspondingly with the first casing, and having an opening disposed opposite to the fixed base;

wherein, the fixed base includes two elastic walls protruded from the first casing, and the two elastic walls are arranged with an interval apart and opposite to each other for installing the power socket between the elastic walls, and a first limit structure is disposed on a side of the two elastic walls, and a second limit structure is disposed on the other side of the two elastic walls, and the first and second limit structures restrict the power socket to be situated in the fixed base and configured to be corresponsive to the opening, wherein the two elastic walls have a latching edge for latching the power socket, the latching edge is protruded along an upper end of any one of the elastic walls and towards the power socket, and the first limit structure is extended out from an end of the latching edge.

2. The adapter casing module of claim 1, wherein the first casing has a bottom and a first side portion is disposed continuously around the periphery of the bottom, and the fixed base is situated on an inner surface of the bottom.

3. The adapter casing module of claim 2, wherein the second casing has a top and a second side portion is disposed continuously around the periphery of the top, and the opening is situated on the top.

4. The adapter casing module of claim 3, wherein the top has an outer surface aligned precisely with an end surface of the power socket.

5. The adapter casing module of claim 4, wherein the top has an inner surface with a retaining wall protruded from and formed around the opening, and the retaining wall directly contacts the two elastic walls.

6. The adapter casing module of claim 3, wherein the top has an inner surface with a retaining wall protruded from and formed around the opening, and the retaining wall directly contacts the two elastic walls.

7. The adapter casing module of claim 1, wherein the second limit structure is an erected wall.

8. The adapter casing module of claim 1, wherein the second limit structure is an erected wall.

9. The adapter casing module of claim 8, wherein the second limit structure is integrally coupled to the other side of the two elastic walls to form a U-shape.

10. The adapter casing module of claim 1, wherein an embedded slot is formed around an outer periphery of the power socket, and the latching edge is latched into the embedded slot for securing the power socket.

* * * * *